US005941212A

United States Patent [19]

Murakami et al.

[11] Patent Number: 5,941,212

[45] Date of Patent: Aug. 24, 1999

[54] AIR-FUEL RATIO CONTROL SYSTEM FOR INTERNAL COMBUSTION ENGINES

[75] Inventors: Akira Murakami; Seiichi Hosogai; Shigeo Hidai; Eisaku Gosho, all of Wako, Japan

[73] Assignee: Honda Giken Kogyo Kabushiki Kaisha, Tokyo, Japan

[21] Appl. No.: 09/150,208

[22] Filed: Sep. 9, 1998

[30] Foreign Application Priority Data

Sep. 19, 1997 [JP] Japan ..... 9-271988

[51] Int. Cl.[6] ..... F02D 41/14; F02D 41/12

[52] U.S. Cl. ..... 123/325; 123/675; 123/682; 123/493

[58] Field of Search ..... 123/326, 675, 123/325, 682, 680, 493

[56] References Cited

U.S. PATENT DOCUMENTS

| | | | |
|---|---|---|---|
| 4,391,243 | 7/1983 | Bessho | 123/325 |
| 4,539,643 | 9/1985 | Suzuki et al. | 123/325 |
| 5,638,802 | 6/1997 | Maki et al. | 123/675 |
| 5,694,902 | 12/1997 | Miwa et al. | 123/493 |
| 5,784,880 | 7/1998 | Toshiro et al. | 60/277 |

FOREIGN PATENT DOCUMENTS 63-27533 6/1988 Japan .

*Primary Examiner*—Tony M. Argenbright
*Assistant Examiner*—Mahmoud M. Gimie
*Attorney, Agent, or Firm*—Nikaido, Marmelstein, Murray & Oram LLP

[57] ABSTRACT

An air-fuel ratio control system for an internal combustion engine includes an ECU which cuts off fuel supply to the engine at deceleration thereof, measures a fuel cut-off period over which the fuel cut-off means cuts off fuel supply to the engine, and enriches the air-fuel ratio of a mixture supplied to the engine to a degree dependent upon the measured fuel cut-off period, at the restart of fuel supply to the engine immediately after termination of cutting-off of fuel supply to the engine. When a second cutting-off of fuel supply to the engine is carried out within a predetermined time period after the restart of fuel supply to the engine immediately after termination of a first cutting-off of fuel supply to the engine, the ECU sets the degree of enriching the air-fuel ratio of the mixture supplied to the engine according to the sum of a first fuel cut-off period over which the first cutting-off of fuel supply to the engine lasted and a second fuel cut-off period over which the second cutting-off of fuel supply to the engine lasted.

9 Claims, 8 Drawing Sheets

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system which has a function of setting the degree of enriching the air-fuel ratio of a mixture supplied to the engine at the restart of fuel supply to the engine immediately after termination of fuel cut-off, according to the fuel cut-off period.

2. Prior Art

When cutting-off of fuel supply to an internal combustion engine (hereinafter referred to as "fuel cut-off") is carried out, the amount of an oxygen component (O2) in exhaust gases from the engine relatively increases, and the increased amount of oxygen is absorbed by an exhaust gas purifying device within the exhaust pipe so that the interior of the purifying device is brought into an oxidizing atmosphere. Consequently, nitrogen oxides (NOx) emitted from the engine at the restart of fuel supply following fuel cut-off are not well reduced by the exhaust gas purifying device, resulting in an increased emission amount of NOx. To mitigate the oxidizing atmosphere into which the interior of the exhaust gas purifying device is brought, it has been proposed to measure the fuel cut-off period, set an initial value of an increment for the fuel injection amount after fuel cut-off according to the fuel cut-off period, and then progressively decrease the fuel injection amount with the lapse of time, by Japanese Patent Publication (Kokoku) No. 63-27533.

According to this prior art technique, however, in the case where the engine is repeatedly accelerated and decelerated alternately so that fuel cut-off is carried out and then fuel supply is restarted, followed by fuel cut-off, the measured fuel cut-off period is reset to zero at the restart of fuel supply. Consequently, at the restart of fuel supply, an insufficient increment is applied to the fuel injection amount, and accordingly O2 absorbed by a catalyst of the exhaust gas purifying device cannot be desorbed to a sufficient degree to reduce NOx in exhaust gases, which can result in degraded exhaust gas emission characteristics.

SUMMARY OF THE INVENTION

It is an object of the invention to provide an air-fuel ratio control system for internal combustion engines, which is capable of preventing degraded exhaust gas emission characteristics even in the case where the engine is repeatedly accelerated and decelerated alternately so that fuel cut-off is carried out and then fuel supply is restarted, followed by fuel cut-off.

To attain the above object, the present invention provides an air-fuel ratio control system for an internal combustion engine, including fuel cut-off means for cutting off fuel supply to the engine at deceleration thereof, fuel cut-off period-measuring means for measuring a fuel cut-off period over which the fuel cut-off means cuts off fuel supply to the engine, and air-fuel ratio-enriching means for enriching an air-fuel ratio of a mixture supplied to the engine to a degree dependent upon the measured fuel cut-off period, at restart of fuel supply to the engine immediately after termination of cutting-off of fuel supply to the engine.

The air-fuel ratio control system according to the invention is characterized in that:

when a second cutting-off of fuel supply to the after the restart of fuel supply to the engine immediately after termination of a first cutting-off of fuel supply to the engine, the air-fuel ratio-enriching means sets the degree of enriching the air-fuel ratio of the mixture supplied to the engine according to a sum of a first fuel cut-off period over which the first cutting-off of fuel supply to the engine lasted and a second fuel cut-off period over which the second cutting-off of fuel supply to the engine lasted.

Preferably, the air-fuel ratio-enriching means sets the degree of enriching the air-fuel ratio of the mixture supplied to the engine to a higher degree as the sum of the last fuel cut-off period and the present fuel cut-off period is larger.

With the above arrangement, in the case where the fuel supply to the engine is again cut off within the predetermined time period after the restart of the fuel supply immediately after termination of a preceding fuel cut-off, the air-fuel ratio-enriching means sets the degree of enriching the air-fuel ratio of the mixture supplied to the engine to a degree which reflects not only the fuel cut-off period over which the subsequent fuel cut-off lasted but also the fuel cut-off period over which the preceding fuel cut-off lasted. As a result, the fuel increment for the fuel supply amount can be positively increased upon the restart of fuel supply to engine is carried out within a predetermined time period the engine, to enable an oxygen component (O2) absorbed in the catalytic converter to be desorbed in sufficient amounts, whereby the amount of NOx in exhaust gases can be reduced to prevent degraded exhaust gas emission characteristics.

Preferably, when the engine is accelerated at the restart of fuel supply to the engine and the second cutting-off of fuel supply to the engine is carried out within the predetermined time period after the restart of fuel supply to the engine, the air-fuel ratio-enriching means sets the degree of enriching the air-fuel ratio of the mixture supplied to the engine according to the sum of the first fuel cut-off period and the second fuel cut-off period.

Advantageously, the predetermined time period is the minimum time period that is required for an oxygen component absorbed by the catalytic converter during the first fuel cut-off period to be desorbed from the catalytic converter before the start of the second fuel cut-off period.

Preferably, the air-fuel ratio control system according to the invention includes air-fuel ratio feedback control means for feedback-controlling the air-fuel ratio of the mixture supplied to the engine, and the air-fuel ratio-enriching means sets the degree of enriching the air-fuel ratio of the mixture supplied to the engine according to a learned value of an air-fuel ratio correction coefficient used in the feedback-controlling of the air-fuel ratio by the air-fuel ratio feedback control means.

More specifically, the air-fuel ratio-enriching means set the degree of enriching the air-fuel ratio of the mixture supplied to the engine to a higher degree as the learned value of the air-fuel ratio correction coefficient is larger.

More preferably, the learned value of the air-fuel ratio correction coefficient is-calculated when the engine is idling.

With the above arrangement, the degree of enriching the air-fuel ratio of the mixture is set according to the learned value of the air-fuel ratio correction coefficient used in the air-fuel ratio feedback control. As a result, it is possible to absorb variations in the engine control system as well as variations in the composition of fuel used by the engine, to thereby prevent degradation in the NOx reduction effects and drivability due to external disturbances.

Also preferably, the air-fuel ratio-enriching means progressively decreases the degree of enriching the air-fuel ratio of the mixture supplied to the engine with lapse of time.

More preferably, the air-fuel ratio-enriching means sets a rate at which the degree of enriching the air-fuel ratio of the mixture supplied to the engine is progressively decreased to different rates with lapse of time.

With this arrangement, the operating condition of the engine can be smoothly shifted from a condition immediately after termination of fuel-cut-off to a subsequent condition.

The above and other objects, features, and advantages of the invention will become more apparent from the following detailed description taken in conjunction with the accompanying drawings.

BRIEF DESCRIPTION OF THE DRAWINGS

FIGS. 7A to 7C are timing charts useful in explaining examples of operations carried out by the program of FIGS. 3A and 3B, in which:

FIG. 7A shows an example in which the engine is not accelerated after fuel cut-off;

FIG. 7B shows an example in which the engine is accelerated after fuel cut-off, and fuel cut-off is again carried out within a predetermined time period after termination of the first fuel cut-off; and FIG. 7C shows an example in which the engine is accelerated after fuel cut-off, and fuel cut-off is again carried out after the lapse of the predetermined time period.

DETAILED DESCRIPTION

The invention will now be described in detail with reference to drawings showing an embodiment thereof.

Figure 1:
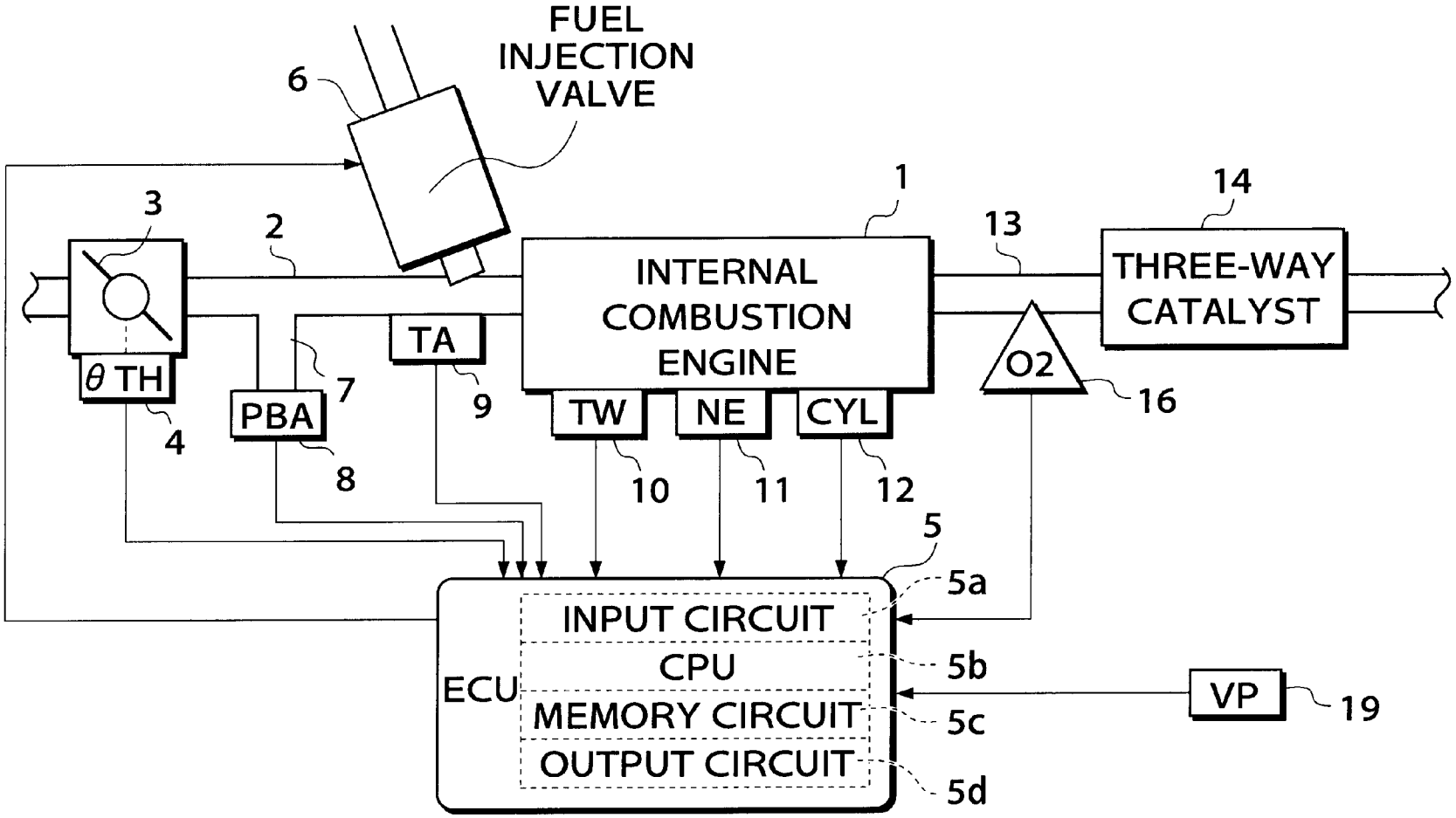
FIG. 1 is a block diagram showing the whole arrangement of an internal combustion engine and an air-fuel ratio control system therefor, according to an embodiment of the invention.

Referring first to FIG. 1, there is schematically shown the whole arrangement of an internal combustion engine and an air-fuel ratio control system therefor, according to an embodiment of the invention.

In the figure, reference numeral 1 designates an internal combustion engine (hereinafter referred to as "the engine"), which has an intake pipe 2 connected to the cylinder block thereof, across which is arranged a throttle valve 3. A throttle valve opening (θTH) sensor 4 is connected to the throttle valve 3, for generating and supplying an electric signal indicative of the sensed throttle valve opening θTH to an electronic control unit (hereinafter referred to as "the ECU") 5.

Fuel injection valves 6, only one of which is shown, are each provided for each cylinder and arranged in the intake pipe 2 at a location between the engine 1 and the throttle valve 3 and slightly upstream of an intake valve, not shown. Each fuel injection valve 6 is connected to a fuel pump, not shown, and electrically connected to the ECU 5 to have its valve opening period controlled by a signal therefrom.

On the other hand, an intake pipe absolute pressure (PBA) sensor 8 is connected to the intake pipe 2 via a conduit 7 at a location immediately downstream of the throttle valve 3, for sensing absolute pressure (PBA) within the intake pipe 2, and is electrically connected to the ECU 5, for supplying an electric signal indicative of the sensed absolute pressure PBA to the ECU 5. Further, an intake air temperature (TA) sensor 9 is inserted into the intake pipe 2 at a location downstream of the PBA sensor 8, for supplying an electric signal indicative of the sensed intake air temperature TA to the ECU 5.

An engine coolant temperature (TW) sensor 10, which may be formed of a thermistor or the like, is mounted in the cylinder block of the engine which is filled with coolant, for supplying an electric signal indicative of the sensed engine coolant temperature TW to the ECU 5. An engine rotational speed (NE) sensor 11 and a cylinder-discriminating (CYL) sensor 12 are arranged in facing relation to a camshaft or a crankshaft of the engine 1, neither of which is shown. The NE sensor 11 generates a signal pulse (hereinafter referred to as "a TDC signal pulse") at a predetermined crank angle before a top dead center (TDC) of each cylinder corresponding to the start of an intake stroke thereof whenever the crankshaft rotates through 180 degrees if the engine is a four-cylinder type, while the CYL sensor 12 generates a signal pulse at a predetermined crank angle of a particular cylinder of the engine, both of the pulses being supplied to the ECU 5.

A three-way catalyst (catalytic converter) 14 is arranged in an exhaust pipe 13 connected to the cylinder block of the engine 1, for purifying noxious components in exhaust gases from the engine, such as HC, CO, and NOx. An oxygen concentration sensor 16 as an air-fuel ratio sensor is arranged in the exhaust pipe 13 at a location upstream of the three-way catalyst 13 (hereinafter referred to as "the O2 sensor 16", for detecting the concentration of oxygen present in exhaust gases and supplying an electric signal indicative of whether the air-fuel ratio of a mixture supplied to the engine 1 is richer or leaner than a stoichiometric air-fuel ratio, based on the sensed oxygen concentration to the ECU 5. Further, a vehicle speed (VP) sensor 19 is electrically connected to the ECU 5, for sensing traveling speed VP of an automotive vehicle, not shown, in which the engine 1 is installed, and supplying an electric signal indicative of the sensed vehicle speed VP to the ECU 5.

The ECU 5 is comprised of an input circuit 5*a* having the functions of shaping the waveforms of input signals from various sensors mentioned above, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed by the CPU 5*b* and for storing results of calculations therefrom, etc., and an output circuit 5*d* which delivers driving signals to the fuel injection valves 6.

The CPU 5*b* operates in response to the above-mentioned signals from the sensors to determine operating conditions in which the engine 1 is opera ting, such as an air-fuel ratio feedback control region in which air-fuel ratio feedback control is carried out in response to the concentration of oxygen in exhaust gases detected by the O2 sensor 16, and air-fuel ratio open-loop control regions, and calculates, based upon the determined engine operating conditions, the valve opening period or fuel injection period TOUT over which the fuel injection valves 6 are to be opened, by the use of the following equation (1), in synchronism with generation of TDC signal pulses:

$$TOUT=TI\times KO2\times KAFC\times K1+K2 \quad (1)$$

where TI represents a basic value of the fuel injection period TOUT, which is determined according to the engine rotational speed NE and the intake pipe absolute pressure PBA such that the air-fuel ratio of a mixture supplied to the engine 1 becomes a stoichiometric air-fuel ratio. A map for determining the TI value is stored in the memory means 5*c*.

KO2 represents an air-fuel ratio correction coefficient which is determined based on the output signal (output voltage PVO2) from the upstream O2 sensor 16 such that the air-fuel ratio of the mixture supplied to the engine 1 becomes equal to a desired air-fuel ratio when the engine 1 is operating in the air-fuel ratio feedback control region, while it is set to predetermined values corresponding to the respective air-fuel ratio open-loop control regions of the engine 1 when the engine 1 is in the open-loop control regions.

KAFC represents an after-fuel cut-off air-fuel ratio-enriching coefficient which is applied immediately after termination of fuel cut-off to enrich the air-fuel ratio of the mixture supplied to the engine 1 to a degree according to the fuel cut-off period at the restart of fuel supply to the engine 1. The coefficient KAFC is set to a value larger than 1.0 and calculated by a process shown in FIGS. 3A and 3B, described hereinafter.

K1 and K2 represent other correction coefficients and correction variables, respectively, which are set according to engine operating parameters to such values as optimize operating characteristics of the engine, such as fuel consumption and engine accelerability.

The CPU 5*b* supplies driving signals via the output circuit 5*d* to the fuel injection valves 6, based on the fuel injection period TOUT thus calculated, to drive the fuel injection valves 6.

Figure 2:
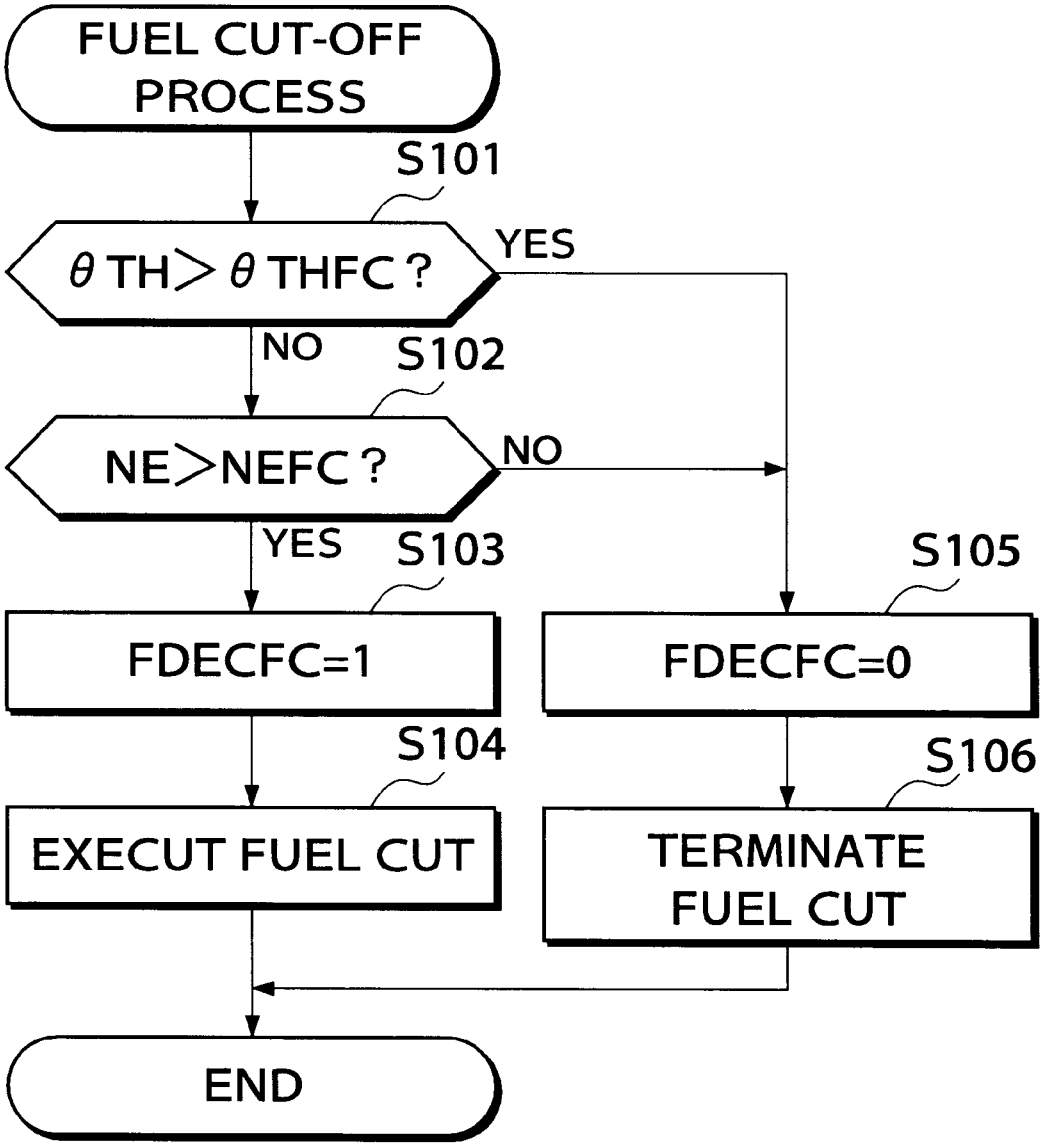
FIG. 2 is a flowchart showing a program for controlling execution of fuel cut-off for the engine in FIG. 1 and termination of the same.

FIG. 2 shows a program for controlling execution of fuel cut-off for the engine in FIG. 1 and termination of the same. This program is executed by the CPU 5*b* in synchronism with generation of each TDC signal pulse.

First, at a step S101, it is determined whether or not the throttle valve opening θTH is larger than a predetermined very small value θTHFC (e.g. 0.5 degrees) which can be assumed when the throttle valve 3 is substantially fully closed. If θTH≦θTHFC holds, it is determined at a step S102 whether or not the engine rotational speed NE is higher than a predetermined value NEFC (e.g. 1000 rpm).

If it is determined at the steps S101 and S102 that θTH≦θTHFC and NE>NEFC hold, a fuel cut-off execution flag FDECFC, which, when set to "1", indicates that fuel cut-off is being carried out, is set to "1" at a step S103, and then fuel cut-off is carried out at a step S104, followed by terminating the program.

If it is determined at the step S101 or S102 that θTH>θTHFC or NE≦NEFC holds, the fuel cut-off execution flag FDECFC is set to "0" at a step S105, and then the fuel cut-off is terminated at a step S106, followed by terminating the program.

Figure 3A:
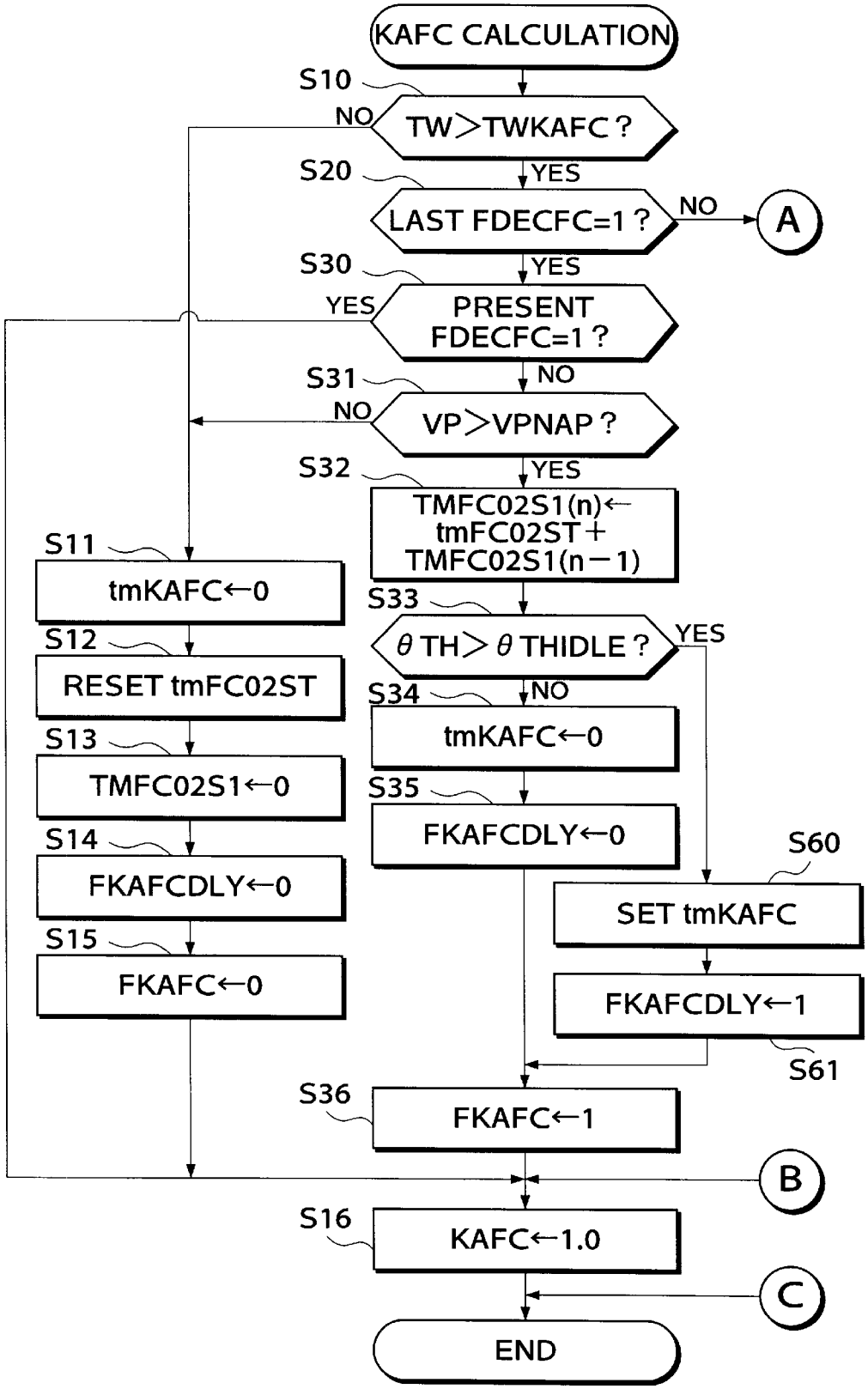
FIG. 3A is a flowchart showing a program for calculating an after-fuel cut air-fuel ratio-enriching coefficient KAFC for enriching the air-fuel ratio of a mixture supplied to the engine after fuel cut-off.
Figure 3B:
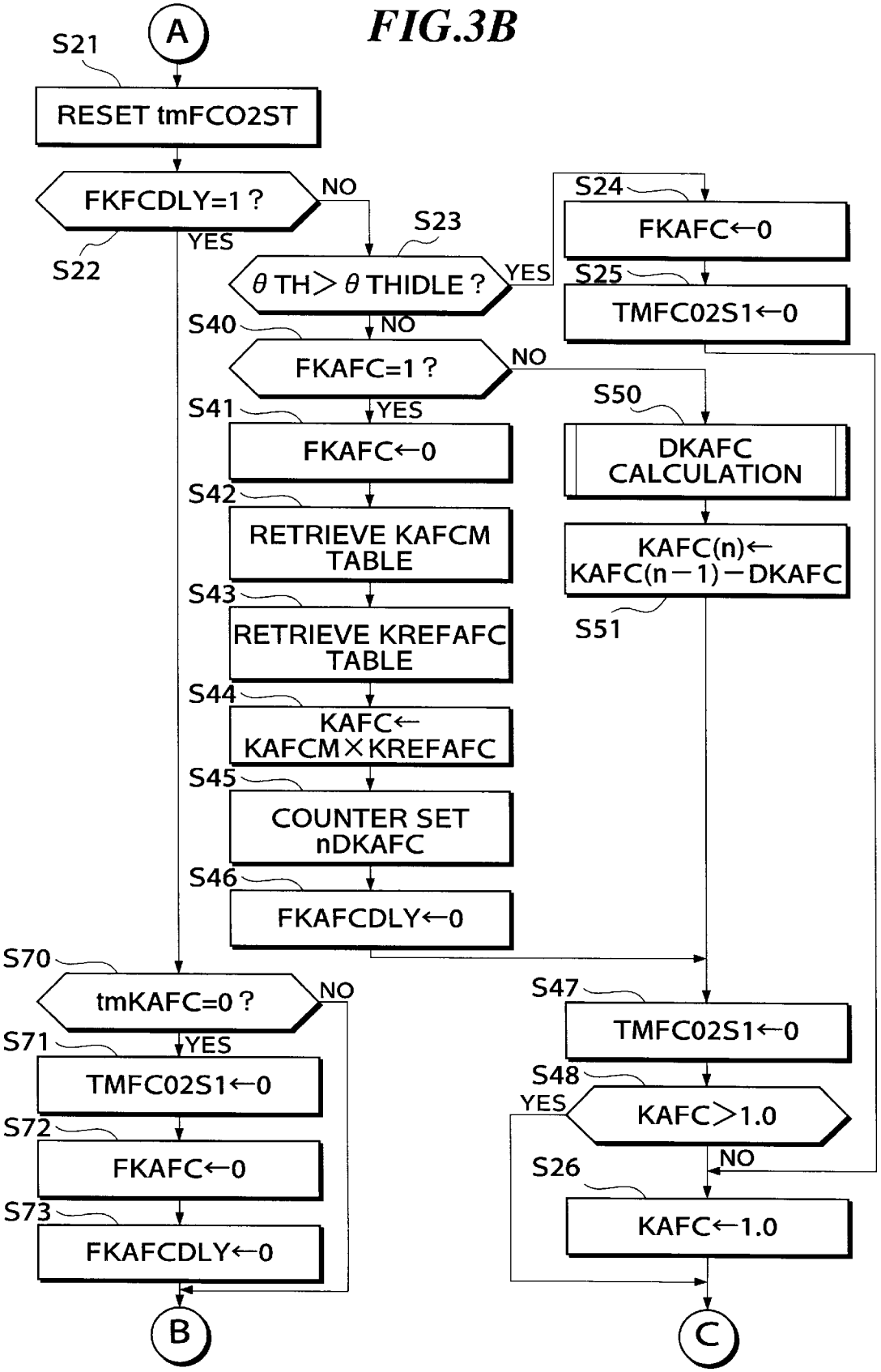
FIG. 3B is a continued part of the flowchart of FIG. 3A.

FIGS. 3A and 3B show a program for calculating the air-fuel ratio-enriching coefficient KAFC. The program is executed by the CPU 5*b* in synchronism with generation of each TDC signal pulse.

Figure 7A:
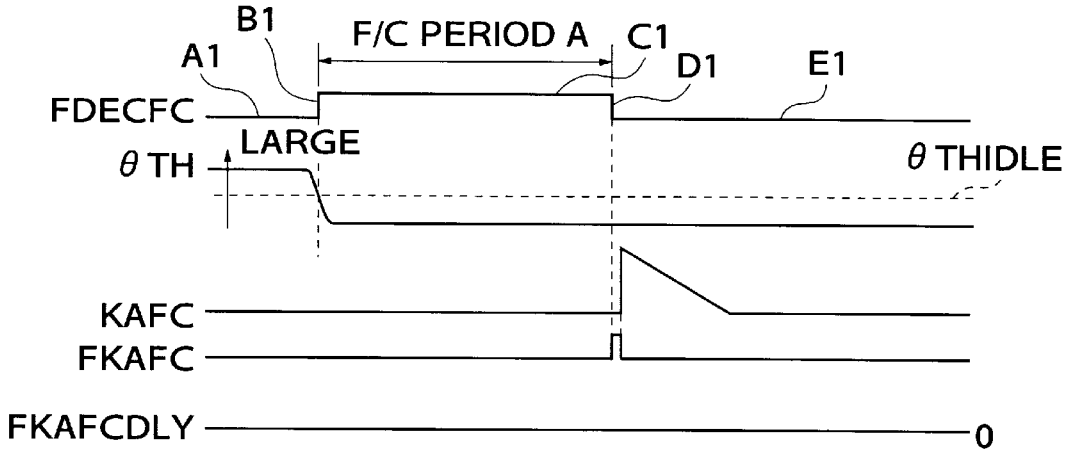
Figure 7B:
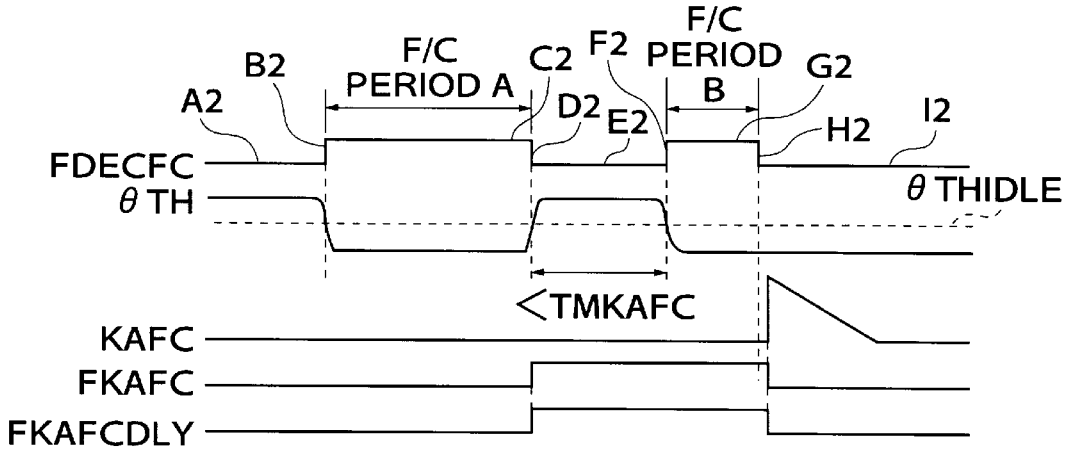
Figure 7C:
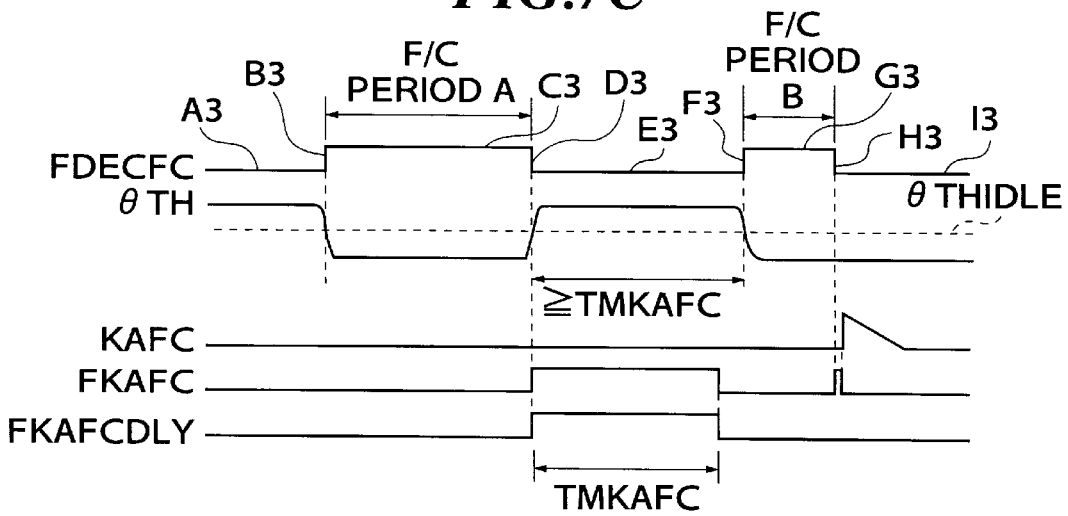

Now, examples of the operation of calculating the coefficient KAFC will be explained with reference to FIGS. 7A, 7B and 7C. FIG. 7A shows an example in which the engine is not accelerated after fuel cut-off. FIG. 7B shows an example in which the engine is accelerated after fuel cut-off, and fuel cut-off is again carried out within a predetermined time period after termination of the first fuel cut-off. FIG. 7C shows an example in which the engine is accelerated after fuel cut-off, and fuel cut-off is again carried out after the lapse of the predetermined time period. Symbols A1 to E1 in FIG. 7A, A2 to I2 in 7B, and A3–I3 in FIG. 7C each indicate timing of change in the fuel cut-off execution flag FDECFC.

(1) Where the engine 1 is not accelerated after fuel cut-off (FIG. 7A).

First, at a step S10, it is determined whether or not the engine coolant temperature TW is higher than a predetermined value TWKAFC (e.g. 80° C.). If TW≦TWKAFC holds, a down-count timer tmKAFC is set to "0" at a step S11, an up-count timer tmFC02ST is reset at a step S12, a fuel cut-off period TMFC02S1 is set to "0" at a step S13, a flag FKAFCDLY, which, when set to "1", indicates that fuel supply to the engine 1 immediately after fuel cut-off at deceleration of the engine 1 has been caused by acceleration (re-acceleration) of the engine, is set to "0" at a step S14, a flag FKAFC, which, when set to "1", indicates that the air-fuel ratio-enriching coefficient KAFC is to be increased after fuel cut-off at deceleration of the engine, is set to "0" at a step S15, and the air-fuel ratio-enriching coefficient KAFC is set to 1.0 at a step S16, followed by terminating the program.

On the other hand, if TW>TWKAFC holds at the step S10, the program proceeds to a step S20, wherein it is determined whether or not a last value of the fuel cut-off execution flag FDECFC which was set or reset by the FIG. 2 program, is equal to "1". Initially, the engine 1 is just before entering a fuel cut-off state in which the flag FDECFC assumes "0" (S101→S105→S106 in FIG. 2; A1), then the timer tmFC02ST is reset at a step S21 in FIG. 3B, and it is determined at a step S22 whether or not the flag FKAFCDLY assumes "1". Since initially the flag FKAFCDLY is reset to "0", the program proceeds to a step S23, wherein it is determined whether or not the throttle valve opening θTH is larger than a predetermined value θTHIDLE to be assumed when the engine 1 is idling. Initially, i.e. before entering the fuel cut-off, θTH>θTHIDLE holds, and accordingly the flag FKAFC is set to "0" at a step S24, the fuel cut-off period TMFC02S1 is set to "0" at a step S25, and the coefficient KAFC is set to 1.0 at a step S26, followed by terminating the program.

If the engine 1 is decelerated into a fuel cut-off state (S101 to S104 in FIG. 2) when TW>TWKAFC holds at the step S10, it is determined at the step S20 that the last value of the flag FDECFC is equal to "1", and then it is determined at a step S30 that a present value of the flag FDECFC is equal to "1" (C1). In this case, the program jumps to the step S16 to set the coefficient KAFC to 1.0, followed by terminating the program.

When the engine rotational speed NE drops below the predetermined value NEFC during the fuel cut-off at deceleration, fuel cut-off is terminated (S101→S102→S105→S106 in FIG. 2), that is, the fuel cut-off period C1 is terminated (D1), it is determined at the step S20 that the last value of the flag FDECFC is equal to "1", and it is determined at the step S30 that the present value of the same flag is equal to "0". Then, the program proceeds to a step S31, wherein it is determined whether or not the vehicle speed VP exceeds a predetermined value VPNAP (e.g. 10 km/h). If VP≦VPNAP holds, the program proceeds to the aforesaid step S11, whereas if VP>VPNAP holds, the count value of the timer tmFC02ST is added to the last fuel cut-off period value TMFC02S1(n−1) by the use of the following equation (2) in step S32 to obtain a present value of the fuel cut-off period TMFC02S1(n):

$$TMFC02S1(n)=tmFC02ST+TMFC02S1(n-1) \quad (2)$$

On this occasion, the last fuel cut-off period value TMFC02S1(n−1) is equal to "0" since the fuel cut-off period TMFC02S1 was set to "0" at the step S25. Therefore, TMFC02S1(n)=tmFC02ST holds from the above equation (2). Here, the timer count value tmFC02ST indicates a time period elapsed after the timer was reset at the step S21 (F/C period A in FIG. 7A).

Then, at a step S33, it is determined whether or not the throttle valve opening θTH is larger than the predetermined value θTHIDLE to be assumed during engine idling. At the time point D1 in FIG. 7A, θTH≦θTHIDLE holds, and accordingly the timer count value tmKAFC is set to "0" at a step S34, the flag FKAFCDLY is set to "0" at a step S35, the flag FKAFC is set to "1" at a step S36, and the aforesaid step S16 is executed to set the coefficient KAFC to 1.0, followed by terminating the program.

After the fuel cut-off period (C1) is terminated when TW>TWKAFC holds at the step S10 (E1), it is determined at the step S20 that the last value of the flag FDECFC assumes "0", and hence the timer tmFC02ST is reset at the step S21, followed by determining whether or not the flag FKAFCDLY assumes "1" at the step S22. Since on this occasion the flag FKAFCDLY has been set to "0" at the step S35, the program proceeds to the step S23 to determine whether or not the throttle valve opening θTH is larger than the predetermined value θTHIDLE at idling. In the present example (1), θTH≦θTHIDLE holds at E1 in FIG. 7A, and accordingly the program proceeds to a step S40, wherein it is determined whether or not the flag FKAFC assumes "1". Since on this occasion the flag FKAFC has been set to "1" at the step S36, the program proceeds to a step S41, wherein the flag FKAFC is set to "0", followed by executing steps S42 to S48 and S26.

Figure 5:
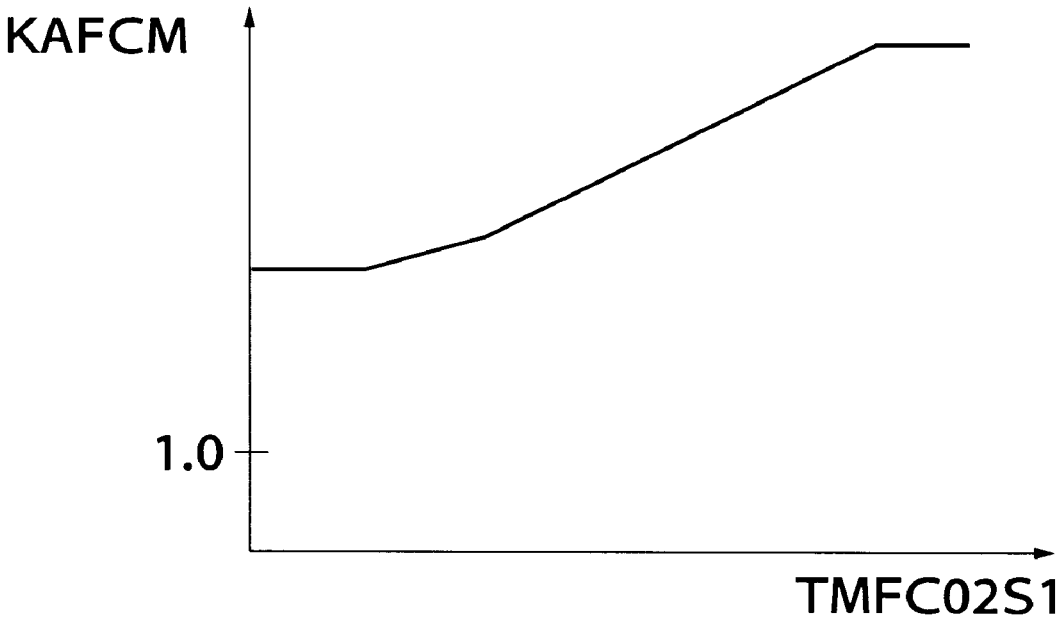
FIG. 5 is a graph showing a table for determining a basic value KAFCM of the enriching coefficient KAFC according a fuel cut-off period TMFC02S1.
Figure 6:
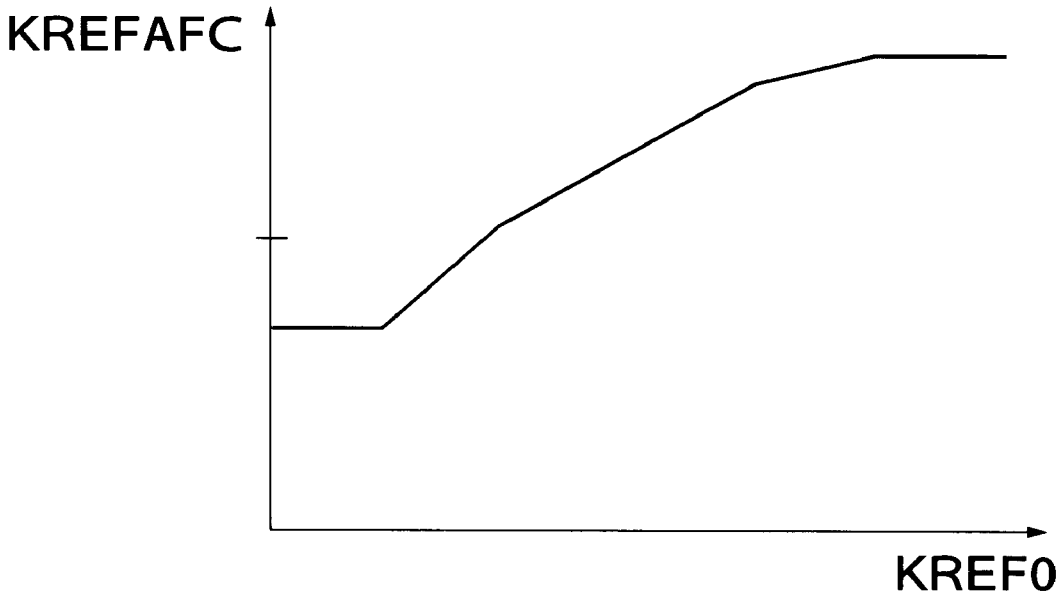
FIG. 6 is a graph showing a table for determining a KAFC correction coefficient KREFAFC according to a learned value KREFO of an air-fuel ratio correction coefficient KO2 calculated at idling of the engine.

More specifically, at the step S42, a KAFCM table in FIG. 5 is retrieved according to the fuel cut-off period TMFC02S1 to determine a basic value KAFCM of the air-fuel ratio-enriching coefficient KAFC. In the table of FIG. 5, the basic value KAFCM is set to a value larger than 1.0 and set to larger values as the fuel cut-off period TMFC02S1 increases. Then, a KREFAFC table is retrieved according to a learned value KREF0 of the air-fuel ratio correction coefficient KO2 used in the air-fuel ratio feedback control during idling of the engine 1 to calculate a KAFC correction coefficient KREFAFC. In the table of FIG. 6, the correction coefficient KREFAFC is set to larger values as the learned value KREF0 increases. The learned value KREF0 of the air-fuel ratio correction coefficient KO2 at idling of the engine 1 is calculated based on values of the air-fuel ratio correction coefficient KO2 applied in the air-fuel ratio feedback control while the engine 1 is idling, by the CPU 5*b*, and stored in the memory means 5*c*. The reason why the learned value KREF0 of the air-fuel ratio correction coefficient KO2 at idling of the engine 1 is adopted as a parameter for calculation of the KAFC correction coefficient KREFAFC is that an idling condition of the engine 1 is close to a condition of the engine 1 immediately after completion of a fuel cut-off state, and further, the use of the learned value of the correction coefficient KO2 can absorb variations in the engine control system as well as variations in the composition of fuel used by the engine 1.

In this way, the KAFC correction coefficient KREFAFC and hence the air-fuel ratio-enriching coefficient KAFC, i.e. the degree of enriching the air-fuel ratio of the mixture is determined by the learned value KREF0 of the air-fuel ratio correction coefficient KO2 used in feedback controlling the air-fuel ratio of the mixture to a desired value, to thereby prevent degradation in the NOx reduction effects and drivability due to external disturbances. Alternatively, a learned value of the air-fuel ratio correction coefficient KO2 which is applied in the air-fuel ratio feedback control in an operating condition of the engine 1 other than idling may be used instead of the learned value KREF0.

Next, the air-fuel ratio-enriching coefficient KAFC is calculated by the use of the following equation (3) (step S44):

$$KAFC=KAFCM\times KREFAFC \quad (3)$$

Then, a counter nDKAFC is set to a predetermined number NDKAFC (step S45), the flag FKAFCDLY is set to "0" (step S46), and the fuel cut-off period TMFC02S1 is set to "0" (step S47). Then, it is determined whether or not the KAFC value exceeds 1.0 (step S48). If KAFC>1.0 holds, the program is immediately terminated, whereas if KAFC≦1.0 holds, the KAFC value is set to 1.0 (step S26), thus carrying out limit-checking of the KAFC value.

Since the flag KAFC has been set to "0" at the step S41, in the next loop, the answer to the question of the step S40 becomes negative (NO), and then the program proceeds to a step S50, wherein a correction amount DKAFC for the air-fuel ratio-enriching coefficient KAFC is calculated by a process of FIG. 4, hereinafter described, and the calculated correction amount DKAFC is deducted from a last value KAFC(n−1) of the enriching coefficient KAFC by the use of the following equation (4) to calculate a present value KAFC(n) of the enriching coefficient KAFC (step S51):

$$KAFC(n)=KAFC(n-1)-DKAFC \quad (4)$$

Then, the fuel cut-off period TMFC02S1 is set to "0" (step S47), followed by limit-checking of the lower limit value of the enriching coefficient KAFC by the steps S48 and S26 and terminating the program.

According to the present example (1), when the engine rotational speed NE drops below the predetermined value NEFC during a fuel cut-off state at deceleration of the engine I (C1), the fuel cut-off is terminated (S101→S102→S105→S106 in FIG. 2, D1), and an initial value of the enriching coefficient KAFC is set based on a value of the fuel cut-off period TMFC02S1 which is set to the count value of the timer tmFC02ST (=F/C period A in FIG. 7A) (steps S42 to S44).

The initial value of the enriching coefficient KAFC is determined by the product of the KAFC value which is set to larger values as the fuel cut-off period TMFC02S1 increases and the KREFAFC value which is set to larger values as the learned value KREF0 of the air-fuel ratio correction coefficient KO2 increases (step S44). This manner of determining the initial value of the enriching coefficient KAFC will be also applied in examples (2) and (3), described hereinbelow.

(2) Where the engine 1 is accelerated after fuel cut-off, and then fuel cut-off is again carried out within a predetermined time period after termination of the first fuel cut-off (FIG. 7B).

At time points A2 to C2 in FIG. 7B, similar processes are carried out to those at the time points A1 to C1 in FIG. 7A. Hereunder, processes carried out at time points C2 et seq. in FIG. 7B will be described.

If the engine 1 is accelerated during a fuel cut-off state at deceleration (C2), so that the fuel cut-off is terminated and hence the fuel cut-off period (C2) is terminated (S101→S105→S106 in FIG. 2, D2), it is determined at the respective steps S20 and S30 that the last value of the flag FDECFC is "1" and the present value of the flag FDECFC is "0", and then the program proceeds to the step S31 to determine whether or not the vehicle speed VP exceeds the predetermined value VPNAP. If VP≦VPNAP holds, the program proceeds to the step S11, whereas if VP>VPNAP holds, the count value of the timer tmFC02S1 is added to the last fuel cut-off period value TMFC02S(n−1) to obtain a present fuel cut-off period value TMFC02S1(n) at a step S32. On this occasion, the last fuel cut-off period value TMFC02S1(n−1) is equal to "0" since the fuel cut-off period TMFC02S1 was set to "0" at the step S25. Therefore, TMFC02S1(n)=tmFC02ST holds from the equation (2). Here, the timer count value tmFC02ST indicates a time period elapsed after the timer was reset at the step S21 (F/C period A in FIG. 7B).

Next, it is determined at a step S33 whether or not the throttle valve opening θTH is larger than the predetermined value θTHIDLE to be assumed at idling. In the present example (2), θTH>θTHIDLE holds at a time point D2 in FIG. 7B. Therefore, the timer tmKAFC is set to a predetermined time period TMKAFC and started at a step S60, the flag FKAFCDLY and the flag FKAFC are both set to "0" at steps S61 and S36, and the step S16 is executed, followed by terminating the program. The predetermined time period TMKAFC is the minimum time period that is required for O2 absorbed by the catalyst of the three-way catalyst 14 during the fuel cut-off period (C2) to be desorbed from the catalyst before the start of the next fuel cut-off period (F2) in the case where fuel supply is restarted after termination of fuel cut-off (D2), and then fuel cut-off is again carried out (G2).

Further, after termination of the fuel cut-off period (C2) (E2), the last value of the flag FDECFC becomes "0", and accordingly the timer tmFC02ST is reset at the step S21, and it is determined at the step S22 whether or not the flag FKAFCDLY assumes "1". On this occasion, the flag FKAFCDLY has been set to "1" at the step 561, and accordingly the program proceeds to a step S70, wherein it is determined the count value of the timer tmKAFC set at the step S60 is equal to "0". Since before the lapse of the predetermined time period TMKAFC, tmKAFC>0 holds, the program jumps to the step S16 to execute the same, followed by terminating the program.

When the engine 1 is again decelerated into a fuel cut-off state before the lapse of the predetermined time period TMKAFC (S101 to S104 in FIG. 2), a new fuel cut-off period (G2) starts (F2). Then, the last value of the flag FDECFC becomes "1" at the step S20, and the present value of the same flag becomes "1" at the step S30, so that the program jumps to the step S16 to execute the same, followed by terminating the program.

During this fuel cut-off state at deceleration of the engine 1, if the engine rotational speed NE drops below the predetermined value NEFC, the fuel cut-off is terminated (S101→S102→S105→S106 in FIG. 2), and hence the fuel cut-off period (G2) is terminated (H2), and then the last value of the flag FDECFC assumes "1" at the step S20 and the present value of the same becomes "0" at the step S30, so that the program proceeds to the step S31 to determine whether or not the vehicle speed VP exceeds the predetermined value VPNAP. If VP≦VPNAP holds, the program proceeds to the step S11, whereas if VP>VPNAP holds, the count value of the timer tmFC02ST is added to the last fuel cut-off period value TMFC02S1(n−1) to obtain a present fuel cut-off period value TMFC02S1(n) at the step S32. Since the last fuel cut-off period value TMFC01S1(n−1) has been set equal to the previous fuel cut-off period (F/C period A in FIG. 7B), the present fuel cut-off period value TMFC02S1(n) is equal to the sum of the previous fuel cut-off period (F/C period A in FIG. 7B) and the count value of the timer tmFC02ST. Here, the timer count value tmFC02ST indicates a time period elapsed after the timer was reset at the step S21 (F/C period B in FIG. 7B).

Then, at the step S33, it is determined whether or not the throttle valve opening θTH is larger than the predetermined value θTHIDLE at idling. In the present example (2), θTH≦θTHIDLE holds at a time point H2 in FIG. 7B, and accordingly the timer tmKAFC is set to "0" at the step S34, the flag FKAFCDLY is set to "0" at the step S35, the flag FKAFC is set to "1" at the step S36, followed by executing the step S16 and terminating the program.

After termination of the fuel cut-off period (G2), the last value of the flag FDECFC becomes "0" at the step S20, and accordingly the timer tmFC02ST is reset at the step S21, and it is determined at the step S22 whether or not the flag FKAFCDLY assumes "1". On this occasion, the flag FKAFCDLY has been set to "0" at the step S35, and accordingly the program proceeds to the step S23 to determine whether or not the throttle valve opening θTH is larger than the predetermined value θTHIDLE at idling. In the present example (2), θTH≦θTHIDLE holds at the time point H2 in FIG. 7B, and accordingly the program proceeds to the step S40 to determine whether or not the flag FKAFC assumes "1". On this occasion, the flag FKAFC has been set to "1" at the step S36, and accordingly the program proceeds to the step S41 to set the flag FKAFC to "0", followed by executing the steps S42 to S48 and S26, and then the steps S50, S51, S47, S48, and S26.

According to the present example (2), the engine 1 is accelerated to terminate the fuel cut-off-at deceleration (E2), and fuel cut-off is again carried out within the predetermined time period TMKAFC (F2). If during this fuel cut-off state the engine rotational speed NE drops below the predetermined value NEFC, the fuel cut-off is terminated (S101→S102→S105→S106 in FIG. 2, H2), and then the initial value of the air-fuel ratio-enriching coefficient KAFC is determined based on the fuel cut-off period TMFC02S1(n) which has been set to the sum of the previous fuel cut-off period (F/C period A in FIG. 7B) and the count value of the timer tmFC02ST (F/C period B in FIG. 7B) at the step S32.

(3) Where the engine 1 is accelerated after fuel cut-off, and then fuel cut-off is again carried out after the lapse of a predetermined time period after termination of the first fuel cut-off (FIG. 7C).

At time points A3 to E3 in FIG. 7C, similar processes are carried out to those at the time points A2 to E2 in FIG. 7B. Hereunder, processes carried out at time points E3 et seq. in FIG. 7C will be described.

After termination of the fuel cut-off period (C3) (E3), when the last value of the flag FDECFC becomes "0" at the step S20, the timer tmFC02ST is reset at the step S21, and it is determined at the step S22 whether or not the flag FKAFCDLY assumes "1". On this occasion, the flag FKAFCDLY has been set to "1" at the step S61, and accordingly the program proceeds to the step S70 to determine whether or not the count value of the timer tmKAFC is equal to "0". After the predetermined time period TMKAFC has already elapsed, tmKAFC="0" holds at the step S70, and then the fuel cut-off period TMFC02S1 is set to "0" at the step S71, and the flags FKAFC and FKAFCDLY are set to "0" at the steps S72 and S73, followed by executing the step S16 and terminating the program.

When the engine 1 is again decelerated into a fuel cut-off state after the lapse of the predetermined time period TMKAFC (S101 to S104 in FIG. 2), the fuel cut-off period (G3) starts (F3). Then, the last value of the flag FDECFC assumes "1" at the step S20, and the present value of the same becomes "1". Accordingly, the program jumps to the step S16 to execute the same, followed by terminating the program.

During this fuel cut-off state at deceleration of the engine 1, if the engine rotational speed NE drops below the predetermined value NEFC, the fuel cut-off is terminated (S101→S102→S105→S106 in FIG. 2), and hence the fuel cut-off period (G3) is terminated (H3), and then the last value of the flag FDECFC assumes "1" at the step S20 and the present value of the same becomes "0" at the step S30, so that the program proceeds to the step S31 to determine whether or not the vehicle speed VP exceeds the predetermined value VPNAP. If VP≦VPNAP holds, the program proceeds to the step S11, whereas if VP>VPNAP holds, the count value of the timer tmFC02ST is added to the last fuel cut-off period value TMFC02S1(n−1) to obtain a present fuel cut-off period value TMFC02S1(n) at the step S32. Since the last fuel cut-off period value TMFC01S1(n−1) has been set to "0" at the step S71, the present fuel cut-off period value TMFC02S1(n) is equal to the count value of the timer tmFC02ST. Here, the timer count value tmFC02ST indicates a time period elapsed after the timer was reset at the step S21 (F/C period B in FIG. 7C).

Then, at the step S33, it is determined whether or not the throttle valve opening θTH is larger than the predetermined value θTHIDLE at idling. In the present example (3), θTH≦θTHIDLE holds at a time point H3 in FIG. 7C, and accordingly the timer tmKAFC is set to "0" at the step S34, the flag FKAFCDLY is set to "0" at the step S35, and the flag FKAFC is set to "1" at the step S36, followed by executing the step S16 and terminating the program.

After termination of the fuel cut-off period (G3) (I3), the last value of the flag FDECFC becomes "0" at the step S20, and accordingly the timer tmFC02ST is reset at the step S21, and it is determined at the step S22 whether or not the flag FKAFCDLY assumes "1". On this occasion, the flag FKAFCDLY has been set to "0" at the step S35, and accordingly the program proceeds to the step S23 to determine whether or not the throttle valve opening θTH is larger than the predetermined value θTHIDLE at idling. In the present example (3), θTH≦θTHIDLE holds at the time point H3 in FIG. 7C, and accordingly the program proceeds to the step S40 to determine whether or not the flag FKAFC assumes "1". On this occasion, the flag FKAFC has been set to "1"at the step S36, and accordingly the program proceeds to the step S41 to set the flag FKAFC to "0", followed by executing the steps S42 to S48 and S26, and then the steps S50, S51, S47, S48, and S26.

According to the present example (3), the engine 1 is accelerated to terminate the fuel cut-off at deceleration (E3), and thereafter fuel cut-off is again carried out after the lapse of the predetermined time period TMKAFC (F3). If during this fuel cut-off state the engine rotational speed NE drops below the predetermined value NEFC, the fuel cut-off is terminated (S101→S102→S105→S106 in FIG. 2, H3), and then the initial value of the air-fuel ratio-enriching coefficient KAFC is determined based on the fuel cut-off period TMFC02S1(n) which is set to the count value of the timer tmFC02ST (F/C period B in FIG. 7C) at the step S32.

Figure 4:
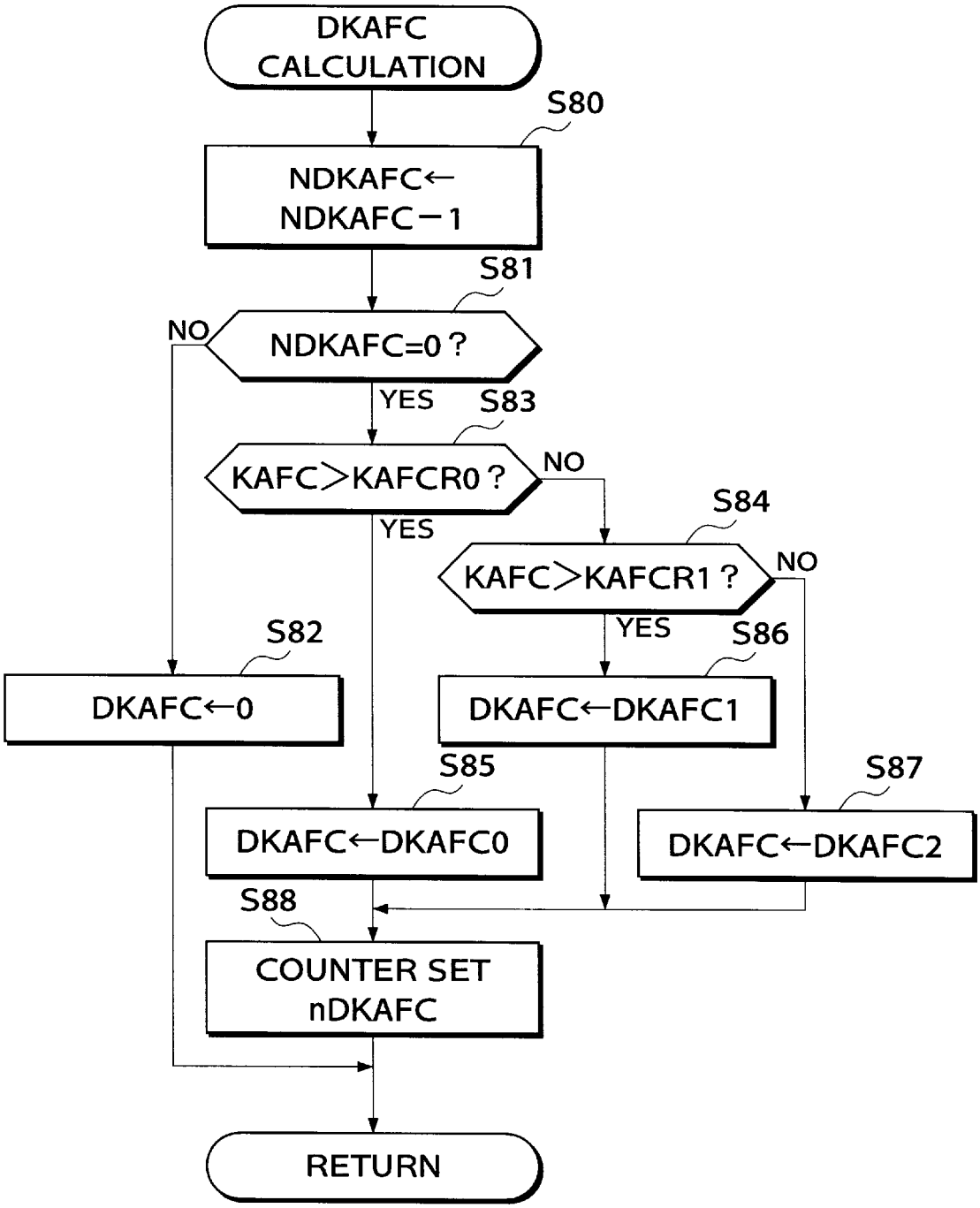
FIG. 4 is a program for calculating a correction amount DKAFC for the enriching coefficient KAFC, which is executed at a step S50 in FIG. 3B.

FIG. 4 shows a program for calculating the correction amount DKAFC for the air-fuel ratio-enriching coefficient KAFC, which is executed at the step S50 in FIG. 3B.

First, at a step S80, the count value of the counter nDKAFC is decremented by 1 from the value NDKAFC to which the counter nDKAFC has been set at the step S45 in FIG. 3B. Then, it is determined at a step S81 whether or not the count value is equal to "0". If it is not equal to "0", the correction amount DKAFC is set to "0" at a step S82, followed by terminating the program.

If it is determined at the step S81 that the count value is equal to "0", it is determined at a step S83 whether or not the coefficient KAFC is larger than a predetermined value KAFCR0 (e.g. 60% of the initial value). If KAFC≦KAFCR0 holds, it is determined at a step S84 whether or not the coefficient KAFC is larger than a predetermined value KAFCR1 (e.g. 30% of the initial value).

If KAFC>KAFCR0 holds at the step S83, the correction amount DKAFC is set to a predetermined value DKAFC0 at a step S85, whereas if KAFCR0≧KAFC>KAFCR1 holds at the steps S83 and S84, the correction amount DKAFC is set to a predetermined value DKAFC1 at a step S86. If KAFC≦KAFCR1 holds at the step S84, the correction amount DKAFC is set to a predetermined value DKAFC2 at a step S87. Then, the counter nDKAFC is set to the DKAFC value thus set, at a step S88, followed by terminating the program. The predetermined values DKAFC0, DKAFC1, and DKAFC2 are in the relationship of DKAFC0>DKAFC2>DKAFC1.

According to the process of FIG. 4, the rate of decrease of the fuel increment (KAFC) from its initial value set based on the measured fuel cut-off period TMFC02S1(n) is set to different values with the lapse of time, so as to enable smooth shifting of the operating condition of the engine from a condition immediately after termination of fuel cut-off to a subsequent operating condition.

What is claimed is:

1. In an air-fuel ratio control system for an internal combustion engine, including fuel cut-off means for cutting off fuel supply to said engine at deceleration thereof, fuel cut-off period-measuring means for measuring a fuel cut-off period over which said fuel cut-off means cuts off fuel supply to said engine, and air-fuel ratio-enriching means for enriching an air-fuel ratio of a mixture supplied to said engine to a degree dependent upon the measured fuel cut-off period, at restart of fuel supply to said engine immediately after termination of cutting-off of fuel supply to said engine, the improvement wherein:

when a second cutting-off of fuel supply to said engine is carried out within a predetermined time period after the restart of fuel supply to the engine immediately after termination of a first cutting-off of fuel supply to the engine, said air-fuel ratio-enriching means sets the degree of enriching the air-fuel ratio of said mixture supplied to said engine according to a sum of a first fuel cut-off period over which said first cutting-off of fuel supply to said engine lasted and a second fuel cut-off period over which said second cutting-off of fuel supply to said engine lasted.

2. An air-fuel ratio control system as claimed in claim 1, wherein when said engine is accelerated at the restart of fuel supply to said engine and said second cutting-off of fuel supply to said engine is carried out within the predetermined time period after the restart of fuel supply to the engine, said air-fuel ratio-enriching means sets the degree of enriching the air-fuel ratio of said mixture supplied to said engine according to the sum of said first fuel cut-off period and said second fuel cut-off period.

3. An air-fuel ratio control system as claimed in claim 1, wherein said engine includes an exhaust system, and a catalytic converter arranged in said exhaust system, and wherein said predetermined time period is a minimum time period that is required for an oxygen component absorbed by said catalytic converter during said first fuel cut-off period to be desorbed from said catalytic converter before start of said second fuel cut-off period.

4. An air-fuel ratio control system as claimed in claim 1, wherein said air-fuel ratio-enriching means sets the degree of enriching the air-fuel ratio of said mixture supplied to said engine to a higher degree as the sum of said last fuel cut-off period and said present fuel cut-off period is larger.

5. An air-fuel ratio control system as claimed in claim 1, including air-fuel ratio feedback control means for feedback-controlling the air-fuel ratio of said mixture supplied to said engine, and wherein said air-fuel ratio-enriching means sets the degree of enriching the air-fuel ratio of said mixture supplied to said engine according to a learned value of an air-fuel ratio correction coefficient used in the feedback-controlling of the air-fuel ratio by said air-fuel ratio feedback control means.

6. An air-fuel ratio control system as claimed in claim 5, wherein said learned value of said air-fuel ratio correction coefficient is calculated when said engine is idling.

7. An air-fuel ratio control system as claimed in claim 5, wherein said air-fuel ratio-enriching means sets the degree of enriching the air-fuel ratio of said mixture supplied to said engine to a higher degree as said learned value of said air-fuel ratio correction coefficient is larger.

8. A air-fuel ratio control system as claimed in claim 1, wherein said air-fuel ratio-enriching means progressively decreases the degree of enriching the air-fuel ratio of said mixture supplied to said engine with lapse of time.

9. A air-fuel ratio control system as claimed in claim 8, wherein said air-fuel ratio-enriching means sets a rate at which the degree of enriching the air-fuel ratio of said mixture supplied to said engine is progressively decreased to different rates with lapse of time.

* * * * *